US005839412A

United States Patent [19]

Stockner et al.

[11] Patent Number: 5,839,412

[45] Date of Patent: Nov. 24, 1998

[54] METHOD FOR ELECTRONIC FUEL INJECTOR OPERATION

[75] Inventors: Alan R. Stockner; William J. Rodier, both of Metamora, Ill.

[73] Assignee: Caterpillar Inc., Peoria, Ill.

[21] Appl. No.: 978,336

[22] Filed: Nov. 25, 1997

[51] Int. Cl.[6] ..... F02M 37/04

[52] U.S. Cl. ..... 123/446; 123/467

[58] Field of Search ..... 123/446, 447, 123/467, 496

[56] References Cited

U.S. PATENT DOCUMENTS

| | | | |
|---|---|---|---|
| Re. 35,079 | 11/1995 | Sverdlin | 123/467 |
| 3,827,409 | 8/1974 | O'Neill | 123/32 EA |
| 4,539,956 | 9/1985 | Hengel et al. | 123/357 |
| 5,092,301 | 3/1992 | Ostdiek | 123/480 |
| 5,181,494 | 1/1993 | Ausman et al. | 123/446 |
| 5,280,773 | 1/1994 | Henkel | 123/467 |
| 5,357,912 | 10/1994 | Barnes | 123/446 |
| 5,357,929 | 10/1994 | McCandless | 123/446 |
| 5,413,082 | 5/1995 | Cook et al. | 123/520 |
| 5,445,129 | 8/1995 | Barnes | 123/446 |
| 5,447,138 | 9/1995 | Barnes | 123/446 |
| 5,477,828 | 12/1995 | Barnes | 123/446 |
| 5,485,820 | 1/1996 | Iwaszkiewicz | 123/446 |
| 5,564,391 | 10/1996 | Barnes | 123/446 |
| 5,586,538 | 12/1996 | Barnes | 123/446 |
| 5,673,669 | 10/1997 | Maley | 123/446 |

*Primary Examiner*—Carl S. Miller
*Attorney, Agent, or Firm*—Fred J. Baehr; Robert J. Hampsch

[57] ABSTRACT

A method of controlling hydraulically actuated, electrically controlled unit fuel injectors to operate in response to the pressure of the working fluid or changes in the pressure of the working fluid is disclosed. The disclosed method comprises controlling the pressure of a high pressure working fluid which operates the fuel injector to inject the proper amount of fuel in the cylinders of an internal combustion engine and varying or adjusting the timing, duration and amplitude of a current pulse which activates the fuel injector in response to the pressure of the working fluid or changes thereto. The fuel injector is activated by energizing a stator that draws an armature to the stator and opens a first seat of the flow regulating device such as a poppet valve against a spring bias to allow the high pressure working fluid into the injector and closes a second seat to prevent the working from draining from the injector to allow the working fluid to operate the injector. Upon deactivation of the stator the spring bias moves the armature away from the stator, closes the first seat and opens the second seat of the poppet valve in a manner that improves the overall performance of the fuel injector.

12 Claims, 4 Drawing Sheets

METHOD FOR ELECTRONIC FUEL INJECTOR OPERATION

TECHNICAL FIELD

The invention relates to an internal combustion engine having an electronic fuel injection system and more particularly to a hydraulically actuated, electronically controlled unit fuel injector which is activated in response to the pressure of the working fluid or changes thereto. The controlled operation involves actuating the stator and thereby moving the armature and poppet valve or other flow regulating device to inject fuel into the associated cylinder.

BACKGROUND ART

Electronic valves controlling fuel or oil in high pressure injections systems such a described in U.S. Pat. No. 5,181,494 requires fuel injectors which operate at high velocity and high pressure to properly meter and inject fuel into the cylinders of internal combustion engines. Operation of hydraulically actuated, electronically controlled unit injectors independent of engine speed allows for the precise control of fuel delivery to the cylinder during ignition delay and main injection phases. Such control is generally known in the art as rate shaping. As is well known in the art, rate shaping modifies engine heat release characteristics, which help reduce emission and noise levels. Rate shaping is a technique that alters the fuel flow through the injector as a function of time and is controlled primarily through regulating the pressure of the working fluid after electronic activation of the unit injector to inject fuel into the associated cylinder. Additional advantages in terms of fuel injector performance, and noise reduction can be realized through the precise control of the electrical activation and deactivation of the unit injector. The present invention realizes such advantages.

DISCLOSURE OF THE INVENTION

The present invention may be characterized as a method of operating hydraulically actuated, electronically controlled unit fuel injector in response to pressure of the working fluid or changes thereto at all operating conditions. The disclosed method is adapted for the operative control of hydraulically actuated electronically controlled unit fuel injectors having a stator, an armature and a poppet valve or other flow regulating device where the valve is connected to the armature and has first and second seats. In general, when electrically activated, the stator draws the armature to the stator and operates the valve or other flow regulating device to open the first valve seat to allow high pressure working fluid to operate an intensifier piston disposed within the fuel injector. The intensifier piston intensifies or greatly increases the pressure of the fuel feed into the injector and injects the highly pressurized fuel into an associated cylinder of an internal combustion engine. In addition, when the stator is electrically activated, the second valve seat is closed, shutting off the flow of working fluid from the injector to a drain. The method when performed in accordance with this invention, comprises the following steps: (a) controlling the amount of fuel injected into the associated cylinder by regulating the pressure of the working fluid; (b) adjusting the timing, duration, and amplitude of a main electrical pulse in response to the working fluid pressure or changes thereto; and (c) generating the main electrical pulse to actuate the stator and move the armature and valve to allow for injection of fuel into the associated cylinder.

The invention may also be characterized as a method for operating a hydraulically actuated, electronically controlled unit fuel injector in response to pressure of the working fluid that includes the steps of generating a main electrical pulse of varying timing, duration and amplitude to actuate the stator and move the armature and valve to allow for injection of fuel into the associated cylinder and generating a secondary electrical pulse after the main electrical pulse, the secondary electrical pulse having a short duration and a current amplitude sufficient to slow down the armature and poppet valve.

BRIEF DESCRIPTION OF THE DRAWINGS

The above and other aspects, features, and advantages of the present invention will be more apparent from the following, more descriptive description thereof, presented in conjunction with the following drawings, wherein.

DETAILED DESCRIPTION OF THE INVENTION

The following description is of the best mode presently contemplated for carrying out the invention. This description is not to be taken in a limiting sense, but is made merely for the purpose of describing the general principals of the invention. The scope and breadth of the invention should be determined with reference to the claims.

Figure 1:
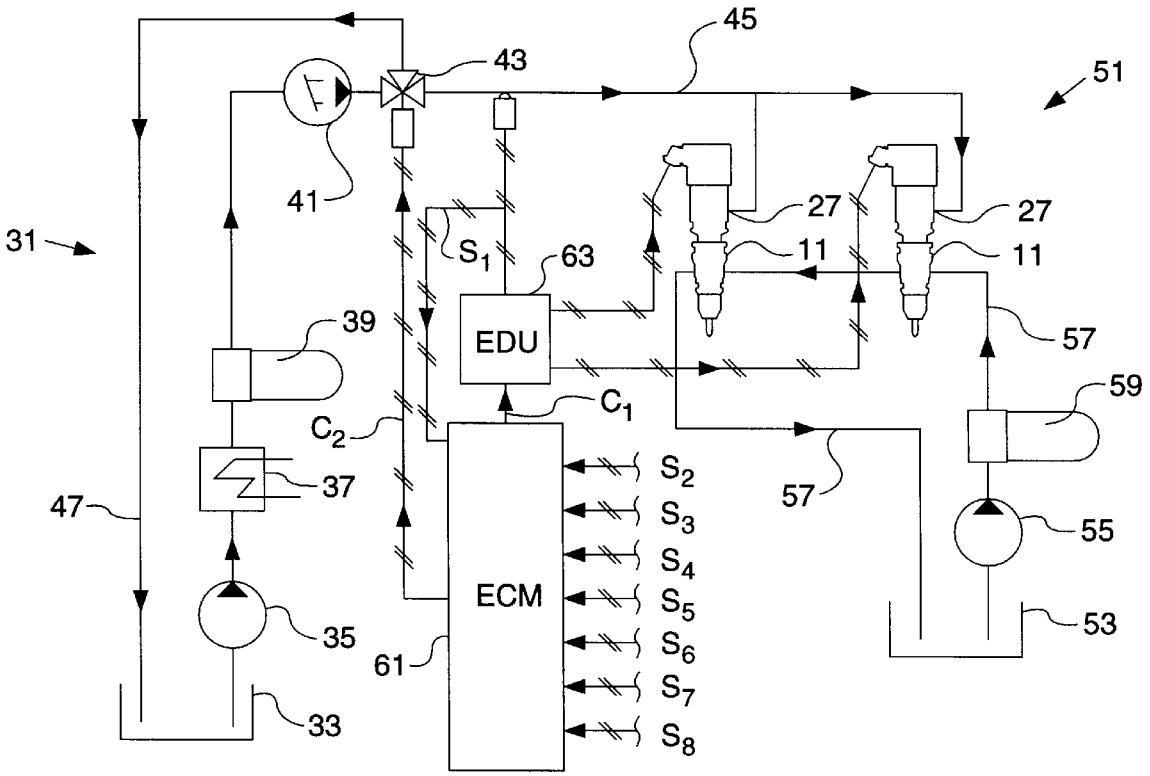
FIG. 1 is a schematic view of a control system for a hydraulically actuated electrically controlled unit injection fuel system.
Figure 2:
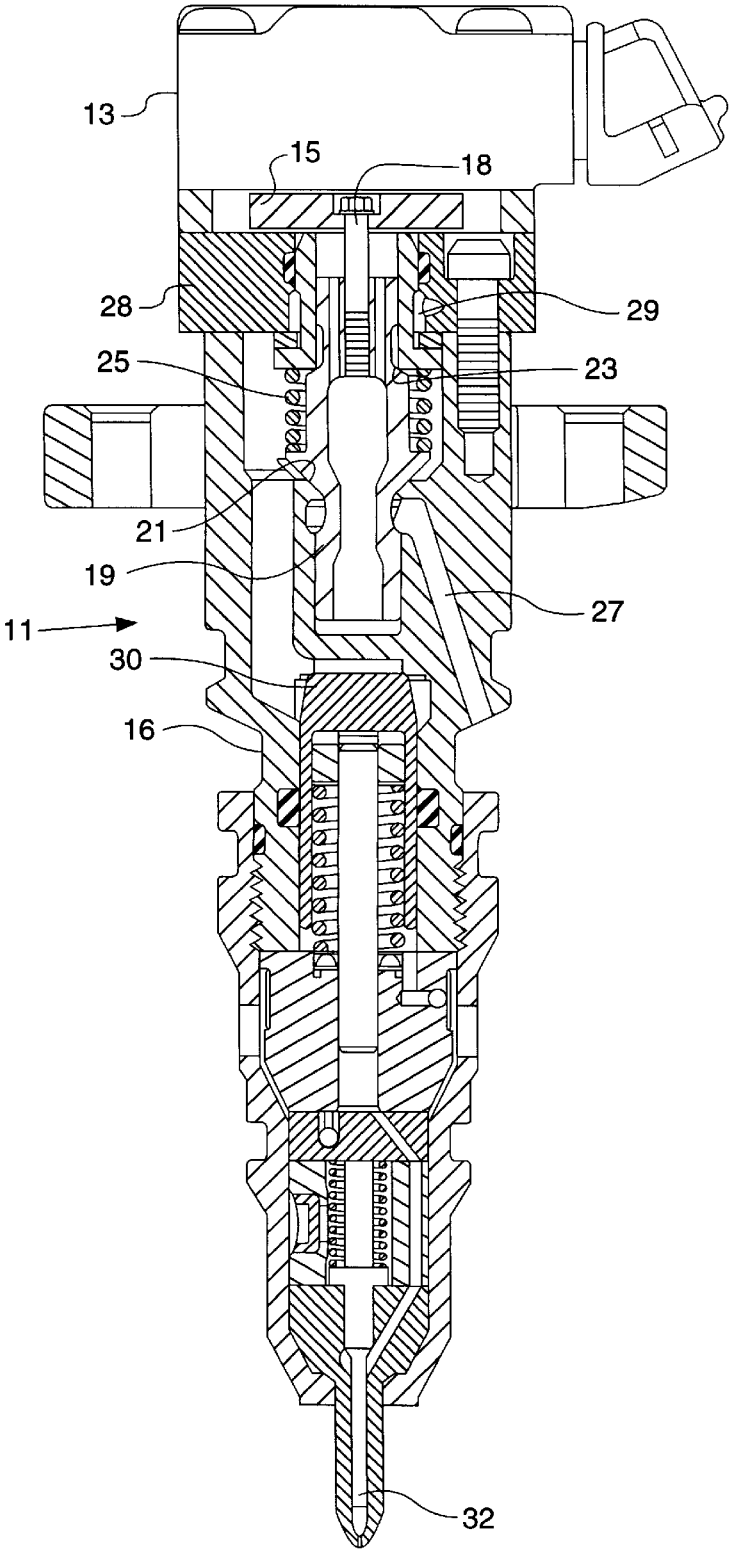
FIG. 2 is sectional view of a hydraulically actuated electrically controlled unit fuel injector.
Figure 3:
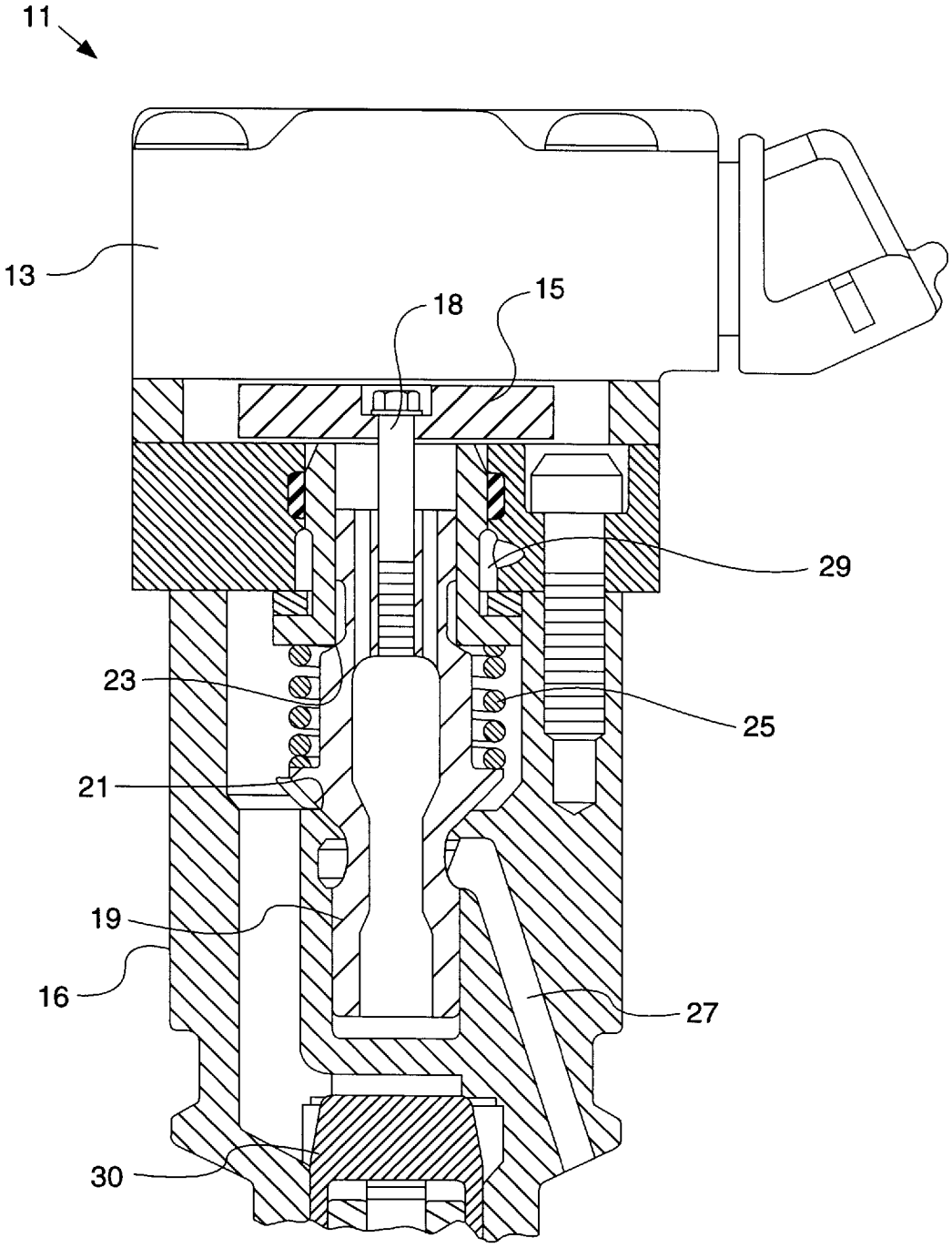
FIG. 3 is an enlarged partial sectional view of the upper portion of a hydraulically actuated electrically controlled unit fuel injector.

Referring now to the drawings in detail and in particular to FIG. 1, there is shown a control system for a hydraulically actuated electrically controlled unit fuel injector 11 for an internal combustion engine (not shown). The fuel injector 11 as shown in FIGS. 2 and 3 comprises a stator 13 and armature 15 disposed at the upper end of an elongated tubular housing 6. The stator 13 has conductive coils (not shown) disposed therein to form an electromagnet which when energized draws the armature 15 to the stator 13. A bolt 18 connects the armature 15 to a poppet valve 19 or other flow regulating device disposed within the housing 16. The poppet valve 19 or other flow regulating device includes a first or lower seat 21 and a second or upper seat 23. A coil spring 25 or other biasing means biases the poppet valve 19 downwardly seating the first seat and closing off a high pressure working fluid inlet port 27. The second or upper seat 23 is not seated, thus opening an upper interior portion 28 of the tubular housing 16 to a drain port 29 to drain excess working fluid therefrom. When the stator 13 is energized, the armature 15 is drawn to the stator 13, compressing the spring 25, moving the poppet valve 19 off the lower seat 21 and seating the upper seat 23 shutting off the flow of working fluid to the drain port 29 and allowing the high pressure working fluid to enter the tubular housing 16 and operate an intensifier piston 30. The intensifier piston 30 pressurizes the fuel to substantially higher pressure than the high pressure working fluid. The highly pressurized fuel operates a needle valve 32 allowing the highly pressurized fuel to be injected into the cylinder (not shown). For a more complete description of the hydraulically actuated electrically controlled unit fuel injector 11 and it operation reference may be made to U.S. Pat. No. 5,181,494 by Ausman et al. entitled "Hydraulically-Actuated Electrically-Controlled Unit Injector" issued Jan. 26, 1993, which is incorporated herein by reference.

Referring again to FIG. 1, there is shown two fuel injectors 1, however, it is understood that there may be any number depending on the size of the engine and the number of cylinders. A working fluid supply system 31 is shown supplying the high pressure working fluid to the working fluid inlet port 27. The drain port 29 relieves the pressure within the tubular housing 16 by draining the working fluid back to the crankcase through passages in the engine block (not shown) as lubricating oil is the preferred working fluid. The working fluid supply system 31 comprises an oil reservoir or crankcase 33, a low pressure pump 35 which pumps the oil through an oil cooler 37 and an oil filter 39 to a high pressure pump 41. The high pressure pump 41 pumps high pressure lubricating oil or working fluid through a pressure regulator 43 and a working fluid supply conduit 45 to the working fluid inlet ports 27 in the fuel injectors 1. A working fluid return conduit 47 returns working fluid from the pressure regulator 43 to the reservoir 33.

A fuel supply system 51 is shown to comprise a fuel tank 53, a fuel pump 55 which pumps the fuel via a fuel conduit 57 through a fuel filter 59 to the injectors 1 and then returns the unused fuel to the fuel tank 53.

An electronic control module 61 often referred to by it acronym ECM receives a plurality of input signals including one or more of the following signals: a high pressure working fluid pressure signal S1; an engine speed signal S2; an inlet manifold pressure signal S3; an exhaust manifold pressure signal S4; an engine coolant temperature signal S5; an engine crankshaft position signal S6; a throttle or desired fuel setting signal S7; and a transmission operating condition signal S8. The ECM 61 contains a plurality of maps in the form of look up tables which may include empirical data specific to the engine and the control apparatus and compares the input signals S1 through S8 to the maps to generate control signals comprising C1 and C2 that operate an electronic drive unit 63 and the pressure regulator valve 43.

The electronic drive unit 63, often referred to by it acronym EDU, is a pulse generator which produces pulses of DC current that vary in timing, amplitude and duration. The EDU 63 contains maps or look-up tables which likewise may include empirical data specific to the engine, and compares the maps or tables to the pressure of the high pressure working fluid, S1 or changes thereto and the control signal C1 from the ECM 61 that comprises a signal that informs the EDU 63 which fuel injector should receive the next pulse and when to send the pulse. Utilizing the incoming signals S1 and C1 the EDU 63 generates a pulse having the proper timing, amplitude and duration.

Figure 4:
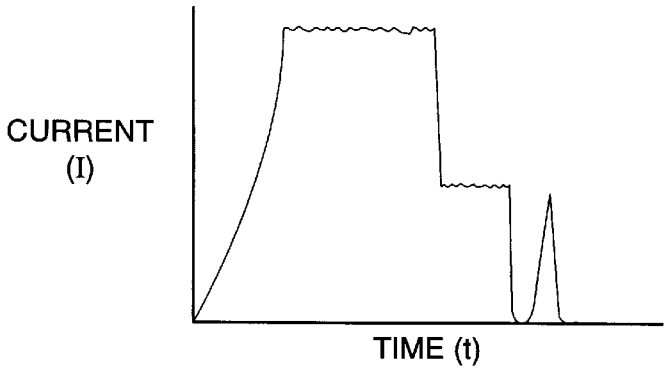
FIG. 4 shows a graph of amplitude of a current pulse verses time.

FIG. 4 shows the amplitude of a pulse of current I verses time t for the pulse to activate the stator 13 when the engine is operating at normal speeds and loads. The current I rises rapidly to an amplitude which will quickly draw the armature 15 to the stator 13 and then drops rapidly to a level which will hold the armature 15 adjacent the stator 13. The current I is maintained at this amplitude for a time period sufficiently long to allow the injector 11 to inject the fuel into the cylinder. The current I then drops rapidly releasing the armature 15 and the spring 25 accelerates the poppet valve 19 toward the lower seat 21. Just before the lower seat 21 is seated, the current I is spiked. The amplitude or the current I rises rapidly to a value sufficient to slow down the armature 15 and poppet valve 19 and then drops rapidly. The energy produced by the spike or secondary pulse slows down the armature 15 and the poppet valve 19 as the lower seat 21 is about to seat. This current spike or secondary pulse reduces the impact on the lower seat 21 and thus improves the overall operation of the fuel injector including the reduction of the noise and wear caused by the seating impact. The duration of the electrical pulse for normal operation of the engine is generally about 2.0 or 3.0 milliseconds, but may vary.

Figure 5:
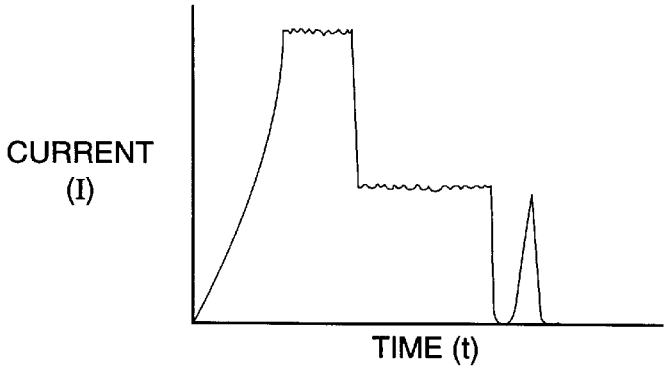
FIG. 5 shows another graph of amplitude of a current pulse verses time.

FIG. 5 shows an amplitude of a pulse of current I verses time t for the pulse to activate the stator 13 when the engine is operating at idle speed or at low loads. The current I rises rapidly to an amplitude which will quickly draw the armature 15 to the stator 13, but for a shorter duration then shown in FIG. 4. The shorter duration reduces the energy the stator 13 applies to the armature 15 and the poppet valve 19. This reduces the velocity of the armature 15 and poppet valve 19 and the seating impact on the upper seat 23 and thus the noise and wear caused by the seating impact. At idle speed and at low loads the pressure of the working fluid is generally reduced causing less fuel to be injected into the cylinders. In general, the working fluid dampens the armature 15 and poppet valve 19, however, the amount of dampening is proportional to the pressure of the working fluid so that dampening decreases with reduced working fluid pressure. The current I then drops rapidly to a level which will hold the armature 15 adjacent the stator 13. The current I is maintained at this amplitude for a time period sufficiently long to allow the injector 11 to inject the fuel into the cylinder. The current I then drops rapidly releasing the armature 15 and the spring 25 accelerates the armature 15 and poppet valve 19 toward the lower seat 21. Just before the lower seat 21 is seated the current I is spiked by means of a secondary pulse. The amplitude of the current I rises rapidly to a value sufficient to slow down the armature 15 and poppet valve 19 and then drops rapidly. The energy produced by the spike or secondary pulse functions to slow down the armature 3 and the poppet valve 19 as the lower seat 21 it is about to seat. This spike reduces the impact on the lower seat 21 and thus improves the overall performance of the fuel injector including reducing the noise and wear caused by the seating impact.

Figure 6:
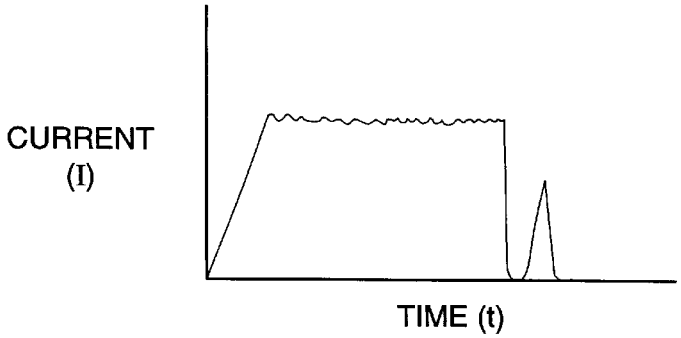
FIG. 6 shows yet another graph of an alternative amplitude of a current pulse verses time.

FIG. 6 shows an alternative amplitude of a pulse of current I verses time t for the pulse that activates the stator 13 when the engine is operating at idle speed and at low loads. The current I rises rapidly to an amplitude which will draw the armature 15 to the stator 13 and hold the armature 15 adjacent the stator 13. The current I is maintained at this amplitude for a time period sufficiently long to allow the injector 11 to inject the fuel into the cylinder. The current I then drops rapidly releasing the armature 15 and the spring 25 accelerates the armature 3 and the poppet valve 19 toward the lower seat 21. The amplitude of the current I is not as high as the amplitude in FIGS. 4 and 5 thus reducing the energy the stator 13 applies to the armature 15 and the poppet valve 19. This reduces the velocity of the armature 15 and poppet valve 19 and the seating impact on the upper seat 23 and thus improves the overall performance of the fuel injector including reduction in the noise and wear caused by the seating impact. At idle speed and at low loads the pressure of the working fluid is reduced causing less fuel to be injected into the cylinders. The working fluid dampens the armature 15 and poppet valve 19 however the amount of dampening is proportional to the pressure of the working fluid. Just before the lower seat 21 is seated the current I is spiked by means of a secondary pulse. The amplitude of the current I rises rapidly to a value less than the current I spike in FIG. 4 and 5 but the duration is longer. The energy produced by this spike slows down the armature 3 and the poppet valve 19 as the lower seat 21 it is about to seat. This spike reduces the impact on the lower seat 21 and thus improves the overall performance of the fuel injector.

A method of controlling hydraulically actuated electronically controlled unit fuel injector comprises three basic steps. The first basic step involves controlling the amount of fuel injected into the associated cylinder by regulating the pressure of the working fluid. The working fluid operates an intensifier piston 30 within the injector 11 to greatly increase or intensify the pressure of the fuel fed to the injector 11. The intensified fuel pressure operates the needle valve 32 injecting the fuel into the associated cylinder at the intensified pressure.

The second basic step involves adjusting the timing, duration, and amplitude of a main electrical pulse in response to the working fluid pressure. The timing, duration, and amplitude are used in generating an electrical pulse to actuate the stator 13 and move the armature 15 and poppet valve 19 to allow the high pressure working fluid into the injector 11 to operate the injector 11 to inject fuel into the associated cylinder.

Finally, the third basic step involves (c) generating the main electrical pulse to actuate the stator and move the armature and poppet valve to inject fuel into the associated cylinder. The electrical pulse has a predetermined duration and amplitude which correspond to the working fluid pressure or measured changes thereto. Such pulses generally operate to improve the performance of the fuel injector and the fuel system in general.

Adjusting or varying the timing, duration, and amplitude of the pulse involves generating a pulse having two distinct steps or segments. In normal engine operating modes, the first segment has a current I that rises rapidly to an amplitude generally about 7.0 amps and remains at that amplitude for a sufficient time to activate the stator 13 and draw the armature 15 rapidly to the stator 13. During the second segment of the pulse, the amplitude of the current I then drops rapidly to an amplitude of generally about 3.5 amps which is sufficient to hold the armature 15 adjacent the stator 13 and the first seat 21 of the poppet valve 19 open. The current I remains at that second segment amplitude for a sufficient time to allow the injector 11 to inject the proper amount of fuel into the associated cylinder. The amplitude of the current I is then dropped rapidly, releasing the armature 15 from the stator 13. The spring 25 moves the poppet valve 19 rapidly toward seating the first or lower seat 21. Just before seating the first seat 21 a current spike or secondary pulse is generated. The amplitude of the current I is raised rapidly to a level which will slow down the armature 15 and the poppet valve 19 and then rapidly dropped. Slowing down the armature 15 and the poppet valve 19 reduces the seating impact which improves the overall performance of the fuel injector.

Similarly, varying or adjusting the timing, duration and amplitude of the main electrical pulse may also involve the generation of different electrical pulse profiles at various operating conditions. These different operating conditions can often be ascertained by looking at the pressure of the working fluid or changes to the pressure of the working fluid. For example, the electrical pulse profile may differ depending on whether the engine is operating in low load and low speed conditions as opposed to normal operating conditions. In the preferred embodiment, the electrical pulse profile for idle speed and low load operation also has two distinct segments. The first segment of idle and low load operation has a current I that rises rapidly to an amplitude generally about 7.0 amps and remains at that amplitude for a sufficient time to draw the armature 15 rapidly to the stator 13. The duration of this first segment is substantially less than the duration of the first segment for normal load operation and preferably about half the duration. Since the pressure or the working fluid is reduced, the damping effect of the working fluid on the armature 15 and poppet valve 19 is also reduced. Therefore to reduce the seating impact on the second seat 23 the magnetic force produced by the first segment is reduced. The amplitude of the current I then drops rapidly to an amplitude of generally about 3.5 amps which is sufficient to hold the armature 15 adjacent the stator 13 and the first seat 21 of the poppet valve 19 open. The current I remains at that amplitude for a sufficient time to allow the injector 11 to inject the proper amount of fuel into the associated cylinder. The duration of the sum of this first and second segment is generally about the same duration as the sum of the duration of the first and second segment pulse produced in normal load operation which is generally about 3.0 milliseconds. The amplitude of the current I is then dropped rapidly, releasing the armature 15 from the stator 13. The spring 25 moves the poppet valve 19 rapidly toward seating the first or lower seat 21. Just before seating the first seat 21 a current spike or secondary electrical pulse is generated. The amplitude of the current I is raised rapidly to a level which will slow down the armature 15 and poppet valve 19 and then rapidly dropped. Slowing down the poppet valve 19 reduces the seating impact and thus reducing the noise and wear produced by the seating impact.

Alternatively, one may vary the timing, duration, and amplitude of the main electrical pulse by generating a pulse for idle and low load operation that comprises generating a pulse having a single segment or step. The single segment having a current I that rises rapidly to an amplitude generally about 4.0 amps and is sufficient to draw the armature 15 rapidly to the stator 13 and to hold the armature 15 adjacent the stator 13 and the first seat 21 of the poppet valve 19 open. The current I remains at this amplitude for a sufficient time to allow the injector 11 to inject the proper amount of fuel into the associated cylinder. The duration of this single segment in generally about the same duration as the sum of the duration of the first and second segment pulse produced for normal load operation or less. The amplitude of the single segment is substantially less than the amplitude of the first segment for normal load operation, since the pressure or the working fluid is reduced and the damping effect of the working fluid on the armature 15 and poppet valve 19 is also reduced. Therefore to reduce the seating impact on the second or upper seat 23 the magnetic force produced by this single segment is reduced. As disclosed above, the amplitude of the current I is then dropped rapidly, releasing the armature 15 from the stator 13. The spring 25 moves the armature 15 and the poppet valve 19 rapidly toward seating the first or lower seat 21. Just before seating the first seat 21 a current spike or secondary electrical pulse is generated. The amplitude of the current I is then raised rapidly to a level which will slow down the armature 15 and the poppet valve 19. The amplitude is not as great as that shown in FIGS. 4 and 5 but the duration is greater providing sufficient energy to slow down the armature 15 and poppet valve 19. As indicated earlier, slowing down the armature 15 and the poppet valve 19 reduces the seating impact and thus, among other advantages, reduces the noise and wear produced by the seating impact.

The method of controlling hydraulically actuated electrically controlled unit fuel injectors as described herein advantageously reduces noise and wear on seats 21 and 23 of the poppet valve 19 and the mating seats within the housing 16 when operating at normal load, at idle speed and at light loads extending their life to reduce maintenance and failures during operation. The performance of the fuel injectors is also improved in terms of fuel system robustness, fuel economy, and overall lower operating costs.

From the foregoing, it should be appreciated that the present invention thus provides a method of operating hydraulically actuated electrically controlled unit fuel injectors in response to changes in pressure of the working fluid. While the invention herein disclosed has been described by means of specific embodiments and processes associated therewith, numerous modifications and variations can be made thereto by those skilled in the art without departing from the scope of the invention as set forth in the claims or sacrificing all its material advantages.

What is claimed is:

1. A method of controlling hydraulically actuated electronically controlled unit fuel injector having a stator, an armature and a flow regulating device with a first and second seat and connected to the armature, the stator, when electrically actuated, draws the armature to the stator and operates the flow regulating device to open a first valve seat to allow working fluid to operate an intensifier piston, which intensifies the pressure of fuel fed to the injector and injects the fuel into an associated cylinder of an internal combustion engine and closes a second valve seat, which when open allows working fluid to drain from the fuel injector, the method comprising the steps of:

controlling the amount of fuel injected into the associated cylinder by regulating the pressure of the working fluid;

adjusting the timing, duration, and amplitude of a main electrical pulse in response to changes in the working fluid pressure; and generating the main electrical pulse to actuate the stator and move the armature and flow regulating device to inject fuel into the associated cylinder.

2. The method of controlling hydraulically actuated electrically controlled unit fuel injectors as set forth in claim 1, wherein the step of adjusting the timing, duration and amplitude of the main electrical pulse comprises utilizing look-up tables to control a electronic drive unit that generates the appropriate electrical pulses.

3. The method of controlling hydraulically actuated electrically controlled unit fuel injectors as set forth in claim 1, wherein the main electrical pulse comprises:

a first segment having a current of sufficient amplitude and duration to draw the armature rapidly to the stator and to operate the flow regulating device; and a second segment in continuity with the first segment and having a current of sufficient amplitude and duration to draw the armature rapidly to the stator and to operate the flow regulating device;

the second segment having a current lower in amplitude than the current of the first segment yet of sufficient amplitude to hold the armature adjacent the stator and the first seat of the flow regulating device open;

the first segment and the second segment having a total duration sufficient to allow the injector to inject the proper amount of fuel into the associated cylinder.

4. The method of controlling hydraulically actuated electrically controlled unit fuel injectors as set forth in claim 3, wherein the step of adjusting the timing duration and amplitude of the pulse comprises generating a secondary electrical pulse having a short duration and a current amplitude sufficient to slow down the armature and flow regulating device just before seating the first seat, the secondary electrical pulse being timed after the second segment.

5. A method of controlling hydraulically actuated electronically controlled unit fuel injector having a stator, an armature and a flow regulating device with a first and second seat and connected to the armature, the stator, when electrically actuated, draws the armature to the stator and operates the flow regulating device to open a first valve seat to allow working fluid to operate an intensifier piston, which intensifies the pressure of fuel fed to the injector and injects the fuel into an associated cylinder of an internal combustion engine and closes a second valve seat, which when open allows working fluid to drain from the fuel injector, the method comprising the steps of:

controlling the amount of fuel injected into the associated cylinder by regulating the pressure of the working fluid;

generating a main electrical pulse of varying timing, duration and amplitude to actuate the stator and move the armature and flow regulating device to inject fuel into the associated cylinder;

generating a secondary electrical pulse having a short duration and a current amplitude sufficient to slow down the armature and flow regulating device just prior to seating the first seat, the secondary electrical pulse being timed after the main electrical pulse.

6. The method of controlling hydraulically actuated electronically controlled unit fuel injectors as set forth in claim 5 wherein the secondary electrical pulse has a short duration and a current amplitude sufficient to slow down the armature and flow regulating device just before seating the first seat.

7. The method of controlling hydraulically actuated electronically controlled unit fuel injectors as set forth in claim 5 wherein the main electrical pulse comprises two distinct steps, the first step having a current of sufficient amplitude and duration to draw the armature rapidly to the stator and to operate the flow regulating device, and a second step having a current lower in amplitude than the current of the first step.

8. The method of controlling hydraulically actuated electronically controlled unit fuel injectors as set forth in claim 7 wherein the secondary electrical pulse has a short duration and a current amplitude sufficient to slow down the armature and flow regulating device just before seating the first seat.

9. The method of controlling hydraulically actuated electronically controlled unit fuel injectors as set forth in claim 5 wherein the step of generating a main electrical pulse further comprises the steps of generating a pulse for normal operation of the engine and generating a different pulse for idle and low load operation of the engine wherein the pulse for normal operation has a current amplitude about the same as the current amplitude for the pulse for idle and low load operation and the pulse for normal operation having a duration longer than the duration of the pulse for idle and low load operation.

10. The method of controlling hydraulically actuated electronically controlled unit fuel injectors as set forth in claim 9 wherein the pulse for normal operation of the engine comprises two distinct segments and the different pulse for idle and low load operation of the engine has a single segment and wherein the pulse for idle and low load operation having an amplitude substantially less than the amplitude of the first segment of the pulse for normal operation and the pulse duration for idle and low load operation is about the same as the combined duration of the two distinct segments of the pulse for normal operation.

11. The method of controlling hydraulically actuated electronically controlled unit fuel injectors as set forth in claim 9 wherein the secondary electrical pulse has a short duration and a current amplitude sufficient to slow down the armature and flow regulating device just before seating the first seat.

12. The method of controlling hydraulically actuated electronically controlled unit fuel injectors as set forth in claim 5 wherein the flow regulating device is a poppet valve.

* * * * *